US008690527B2

(12) United States Patent
Matwey et al.

(10) Patent No.: US 8,690,527 B2
(45) Date of Patent: Apr. 8, 2014

(54) FLOW DISCOURAGING SYSTEMS AND GAS TURBINE ENGINES

(75) Inventors: Mark Matwey, Phoenix, AZ (US); David K. Jan, Fountain Hills, AZ (US)

(73) Assignee: Honeywell International Inc., Morristown, NJ (US)

( * ) Notice: Subject to any disclaimer, the term of this patent is extended or adjusted under 35 U.S.C. 154(b) by 952 days.

(21) Appl. No.: 12/827,296

(22) Filed: Jun. 30, 2010

(65) Prior Publication Data

US 2012/0003084 A1 Jan. 5, 2012

(51) Int. Cl.
*F01D 11/02* (2006.01)

(52) U.S. Cl.
USPC ..... 415/173.7; 416/174

(58) Field of Classification Search
USPC ..... 415/170.1, 173.7, 174.2, 174.3, 174.4, 415/174.5; 416/174; 277/355, 411, 412
See application file for complete search history.

(56) References Cited

U.S. PATENT DOCUMENTS

| | | | | |
|---|---|---|---|---|
| 3,497,225 | A | 2/1970 | Workman | |
| 3,921,987 | A | 11/1975 | Johnston et al. | |
| 4,218,189 | A * | 8/1980 | Pask | 416/174 |
| 4,682,933 | A | 7/1987 | Wagner | |
| 5,090,710 | A * | 2/1992 | Flower | 277/355 |
| 5,217,348 | A | 6/1993 | Rup, Jr. et al. | |
| 5,224,822 | A | 7/1993 | Lenahan et al. | |
| 5,511,886 | A | 4/1996 | Sink | |
| 5,522,698 | A | 6/1996 | Butler et al. | |
| 5,545,004 | A | 8/1996 | Ho et al. | |
| 5,597,167 | A | 1/1997 | Snyder et al. | |
| 5,711,534 | A | 1/1998 | Bengoa et al. | |
| 6,036,192 | A | 3/2000 | Dietle et al. | |
| 6,109,618 | A | 8/2000 | Dietle | |
| 6,276,692 | B1 | 8/2001 | Beeck et al. | |
| 6,481,959 | B1 | 11/2002 | Morris et al. | |
| 6,612,809 | B2 | 9/2003 | Czachor et al. | |
| 7,249,769 | B2 * | 7/2007 | Webster | 277/411 |
| 7,524,163 | B2 | 4/2009 | Self et al. | |
| 7,540,501 | B2 | 6/2009 | Flaherty | |
| 7,578,653 | B2 | 8/2009 | Klasing et al. | |
| 2003/0131602 | A1 * | 7/2003 | Ingistov | 60/772 |
| 2008/0007008 | A1 * | 1/2008 | Hoebel et al. | 277/355 |
| 2008/0080972 | A1 * | 4/2008 | Bunker | 415/174.5 |
| 2008/0310950 | A1 | 12/2008 | Young et al. | |
| 2009/0317244 | A1 | 12/2009 | Howe et al. | |
| 2010/0008760 | A1 | 1/2010 | Morris et al. | |
| 2010/0054924 | A1 * | 3/2010 | Uyama et al. | 415/173.1 |
| 2010/0068042 | A1 * | 3/2010 | Bruck et al. | 415/174.2 |

FOREIGN PATENT DOCUMENTS

WO WO 9214951 A1 * 9/1992

* cited by examiner

*Primary Examiner* — Edward Look
*Assistant Examiner* — Jesse Prager
(74) *Attorney, Agent, or Firm* — Ingrassia Fisher & Lorenz, P.C.

(57) ABSTRACT

A flow discouraging system includes a stator assembly, a rotor assembly, and a plurality of fingers. The stator assembly includes one or more stationary components forming a side wall, the side wall including an annular groove defined by an outer axially-extending surface, an inner axially-extending surface, and a radial surface extending between the outer and inner axially-extending surfaces. The rotor assembly is disposed adjacent to and spaced apart from the stator assembly to form a portion of a cavity and includes an annular rim extending at least partially into the annular groove. The plurality of fingers is disposed in the annular groove and extends from the one or more stationary components the annular rim.

15 Claims, 6 Drawing Sheets

FLOW DISCOURAGING SYSTEMS AND GAS TURBINE ENGINES

STATEMENT REGARDING FEDERALLY SPONSORED RESEARCH OR DEVELOPMENT

This inventive subject matter was made with Government support under DAAH100320007 awarded by the United States Army. The Government has certain rights in this inventive subject matter.

TECHNICAL FIELD

The inventive subject matter generally relates to gas turbine engines, and more particularly relates to enhanced flow discouraging systems for use in gas turbine engines.

BACKGROUND

A turbofan gas turbine engine is used to power aircraft and can include, for example, a fan section, a compressor section, a combustion section, a turbine section, and an exhaust section, where each section has components that are mounted to a rotor. The fan section induces air from the surrounding environment into the engine and accelerates a fraction of the air toward the compressor section. The remaining fraction of air is accelerated into and through a bypass plenum, and out the exhaust section.

The compressor section, which may include a high pressure compressor and a low pressure compressor, raises the pressure of the air it receives from the fan section to a relatively high level. The compressed air then enters the combustion section, where a ring of fuel nozzles injects a steady stream of fuel into a plenum. The injected fuel is ignited to produce high-energy, hot combusted air. The air then flows into and through the turbine section causing turbine blades on a rotating disk to rotate and generate energy. This energy is used to power the fan and compressor sections. The air exiting the turbine section is exhausted from the engine via the exhaust section, and the energy remaining in the exhaust air aids the thrust generated by the air flowing through the bypass plenum.

During operation, the turbine blades, the rotating disk, and other components of the turbine section are exposed to the hot combusted air. To prevent the turbine section components from overheating, a cooling system is included. In some engines, cooling air extracted from other parts of the engine, such as from the compressor section, is bled at compressor-discharge conditions and directed to the turbine section components. To improve cooling effectiveness of the cooling air, a flow rate of the cooling air may be increased. However, because the extraction of cooling air does not contribute to providing power to the turbine for engine operation, providing an excessive quantity of cooling air flow may undesirably increase engine fuel consumption, which can, in turn, reduce the power output of the gas turbine engine. These issues may be exacerbated in the case of small gas turbine engines (e.g., turbine engines having turbine inlet corrected airflows that are less than 1 lbm/sec). In particular, gaps between rotating and non-rotating components of small gas turbine engines, as well as seals included in these engines, are generally designed to minimize clearances therebetween and to have minimum tolerances. Therefore, an amount of gas leakage within small gas turbine engines might not decrease, despite scale-down of engine dimensions.

Accordingly, it is desirable to provide an improved system for cooling the components of an engine turbine section, including an engine turbine section of a small gas turbine engine. In addition, it is desirable for the improved system to cool engine components with minimal effect on engine fuel consumption. Moreover, it is desirable for the improved system to be relatively simple to implement. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Flow discouraging systems and gas turbine engines have been provided.

In an embodiment, by way of example only, a flow discouraging system includes a stator assembly, a rotor assembly, and a plurality of fingers. The stator assembly includes one or more stationary components forming a side wall, the side wall including an annular groove defined by an outer axially-extending surface, an inner axially-extending surface, and a radial surface extending between the outer and inner axially-extending surfaces. The rotor assembly is disposed adjacent to and spaced apart from the stator assembly to form a portion of a cavity and includes an annular rim extending at least partially into the annular groove. A plurality of fingers is disposed in the annular groove and extends from the one or more stationary components the annular rim.

In another embodiment, by of example only, a gas turbine engine includes a compressor section, a combustion section adjacent to the compressor section, and a turbine section adjacent to the combustion section. The turbine section includes a stator assembly including one or more stationary components forming a side wall, the side wall including an annular groove defined by an outer axially-extending surface, an inner axially-extending surface, and a radial surface extending between the outer and inner axially-extending surfaces, a rotor assembly disposed adjacent to and spaced apart from the stator assembly to form a portion of a cavity, the rotor assembly including an annular rim extending at least partially into the annular groove and disposed between the outer axial finger and the inner axial finger, and the cavity in flow communication with the compressor section, and a plurality of fingers disposed in the annular groove and extending from the one or more stationary components the annular rim.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. In particular, although the inventive subject matter is described in the context of turbofan gas turbine engines, the inventive subject matter may be implemented in turbojet, turboprop, turboshaft, auxiliary power generation and pneumatic pressure generation gas turbine engines or any other engine in which a flow discouraging system may be useful. Furthermore, there is no intention to be bound by any theory presented in the preceding background or the following detailed description.

Figure 1:
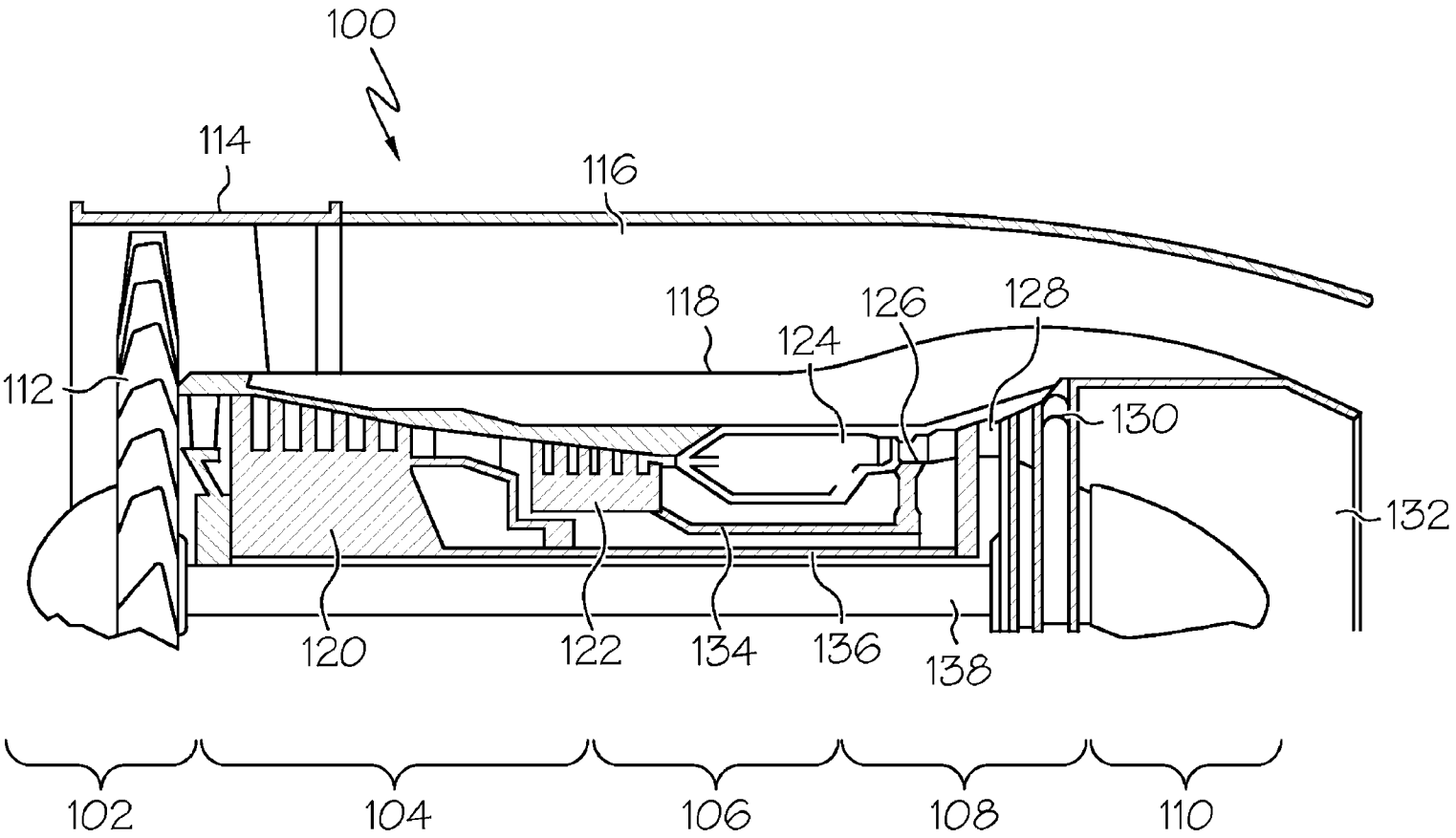
FIG. 1 is a simplified, schematic of a gas turbine engine, according to an embodiment.

FIG. 1 is a simplified schematic of a gas turbine engine 100, according to an embodiment. In accordance with an embodiment, the gas turbine engine 100 may include a system that maintains a flow of hot combusted air along a designated flowpath by reducing or preventing the leakage of the hot combusted air into spaces between rotating and non-rotatable components of the gas turbine engine 100. In this way, an amount of cooling air supplied into the spaces for cooling the components of the gas turbine engine 100 may be reduced, as compared with the amount cooling air used in conventional gas turbine engines. The use of a reduced amount of cooling air may result in an increase in engine efficiency.

In any case, in general, the gas turbine engine 100 includes an intake section 102, a compressor section 104, a combustion section 106, a turbine section 108, and an exhaust section 110. The intake section 102 includes a fan 112, which is mounted in a fan case 114. The fan 112 draws air into the intake section 102 and accelerates it. A fraction of the accelerated air exhausted from the fan 112 is directed through a bypass section 116 disposed between the fan case 114 and an engine bypass duct 118, and provides a forward thrust. The remaining fraction of air exhausted from the fan 112 is directed into the compressor section 104.

The compressor section 104 includes an intermediate pressure compressor 120 and a high pressure compressor 122. The intermediate pressure compressor 120 raises the pressure of the air directed into it from the fan 112, and directs the compressed air into the high pressure compressor 122. The high pressure compressor 122 compresses the air still further, and directs the high pressure air into the combustion section 106. In the combustion section 106, which includes an annular combustor 124, the high pressure air is mixed with fuel and combusted. The hot combusted air is then directed into the turbine section 108.

The turbine section 108 includes a high pressure turbine 126, an intermediate pressure turbine 128, and a low pressure turbine 130 disposed in axial flow series. The hot combusted air from the combustion section 106 expands through the turbines 126, 128, 130, causing each to rotate. The air is then exhausted through a propulsion nozzle 132 disposed in the exhaust section 110, providing additional forward thrust. As each turbine 126, 128, 130 rotates, each drives equipment in the engine 100 via concentrically disposed shafts or spools. Specifically, the high pressure turbine 126 drives the high pressure compressor 122 via a high pressure shaft 134, the intermediate pressure turbine 128 drives the intermediate pressure compressor 120 via an intermediate pressure shaft 136, and the low pressure turbine 130 drives the fan 112 via a low pressure shaft 138.

Figure 2:
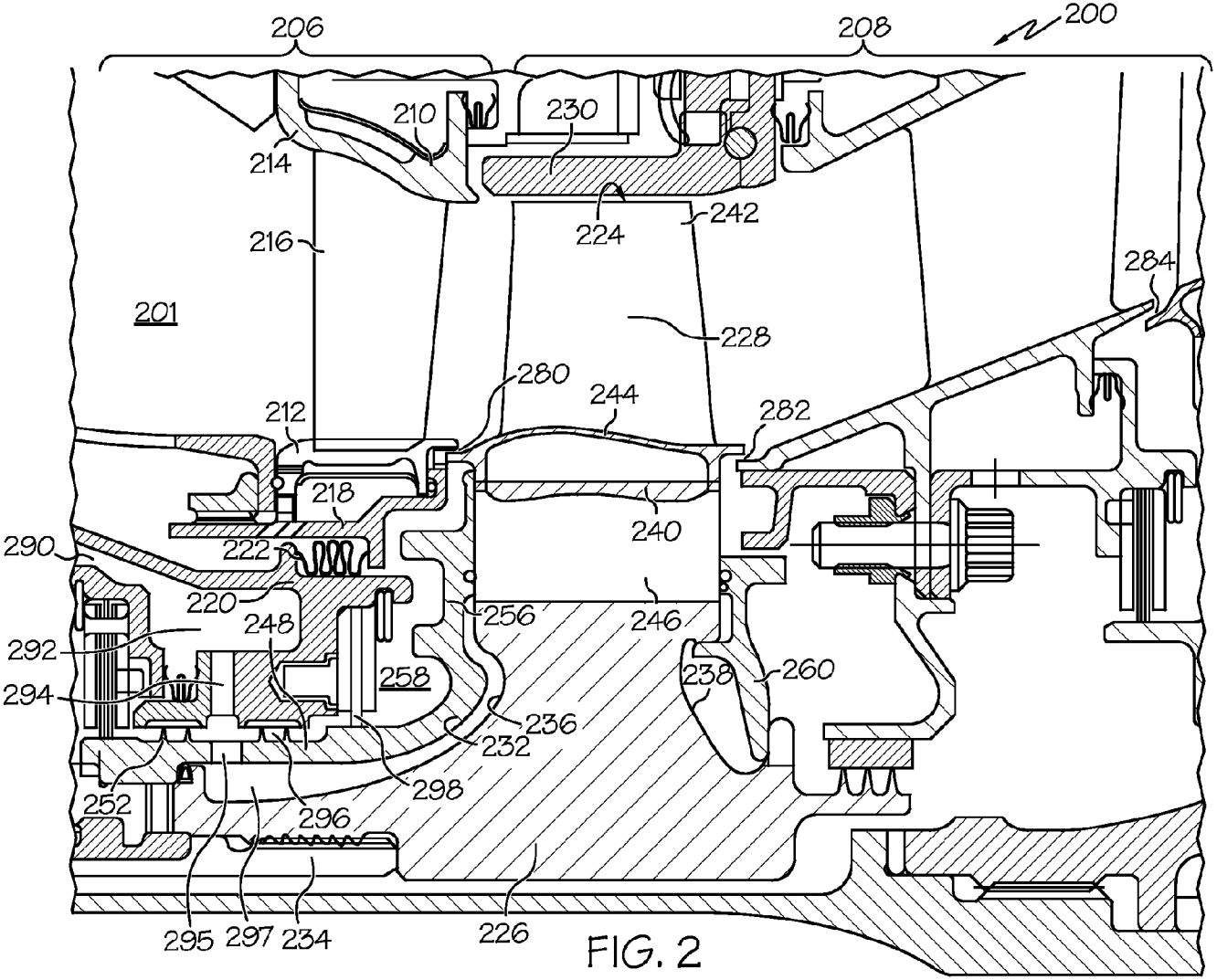
FIG. 2 is a cross-sectional view of a portion of a turbine section of a gas turbine engine, according to an embodiment.

FIG. 2 is a cross-sectional view of a portion of a gas turbine engine 200, according to an embodiment. In accordance with an embodiment, the gas turbine engine 200 includes a main flowpath 201 that extends between a stator assembly and a rotor assembly. In an embodiment, the stator assembly includes components from a combustion section 206, while the rotor assembly may comprise components from a turbine section 208 so that the main flowpath 201 receives a gas flow from a combustor of the combustion section 206. In an example, the components of the combustion section 206 may include a nozzle 210 configured to direct hot combusted air to the turbine section 208. The nozzle 210 has an inner ring 212, an outer ring 214, and a plurality of stationary vanes 216 (only one of which is shown). The plurality of stationary vanes 216 extend between the inner and outer rings 212, 214 and are configured to direct flow of the hot combusted air toward the rotor assembly. According to an embodiment, the inner ring 212 may be mounted to a static support structure 218, which is disposed around a Tangential On Board Injector (TOBI) housing 220. The static support structure 218 may be ring-shaped and may surround the TOBI housing 220. To prevent air leakage between the static support structure 218 and the TOBI housing 220, a seal 222 may be included.

The rotor assembly is disposed adjacent to and is spaced apart from the stator assembly and may comprise a turbine wheel assembly 224 including a hub 226, a plurality of blades 228 (only one of which is shown), a forward cover plate 232, and an aft cover plate 260. In accordance with an embodiment, the hub 226 may be mounted to a shaft 234 and includes a forward face 236 and an aft face 238. The plurality of blades 228 are attached to an outer diameter of the hub 226, and cause the hub 226 to rotate when hot combusted air impinges on the blades 228. Each blade 228 includes a shank 240, an airfoil 242, a platform 244, and a root 246. According to an embodiment, the platform 244 is configured to radially contain airflow from the nozzle 210 along the main flowpath 201. The root 246 is used to attach the blade 228 to the hub 226. In an embodiment, the blades 228 are surrounded by the shroud 230, which defines a portion of the main flowpath with the platform 244.

In an embodiment, the forward cover plate 232 may comprise a portion of a TOBI system that supplies cooling air to cool the blades 228. The forward cover plate 232 includes an axial section 248 for mounting to the hub 226, in an embodiment. In another embodiment, the axial section 248 is disposed radially inwardly from the TOBI housing 220, and one or more seals 252 may be disposed between the axial section 248 and the TOBI housing 220 to reduce air leakage. According to an embodiment, the forward cover plate also includes a radial plate 256, which may extend along the forward face 236 of the hub 226. In an embodiment, an outer periphery of the radial plate 256 may be coupled to the hub 226.

To provide cooling air to the blades 228, the cooling air may be extracted from the compressor section (e.g., compressor section 104 of FIG. 1) and may be diverted into a TOBI cooling air supply circuit 290. The TOBI cooling air supply circuit 290 may deliver cooling air into a TOBI plenum 292. From the TOBI plenum 292, the cooling air may pass through a plurality of TOBI holes 294 and through a plurality of holes 295 in the forward cover plate 232. The cooling air may then flow into a cavity 297 between the forward cover plate 232 and the hub 226. In an embodiment, the cavity 297 defines a pathway along which cooling air can travel. The cooling air may enter the hub 226, passing through the blade root 246 to cool the blades 228.

Cooling air may alternatively or additionally be provided to spaces formed between the stator and rotor assemblies to maintain temperatures of the stator and rotor assembly components at acceptable levels. For example, with reference to FIG. 2, cooling air may be extracted from the compressor section (e.g., compressor section 104 of FIG. 1) and diverted into the TOBI cooling air supply circuit 290. In an embodiment, the TOBI cooling air supply circuit 290 delivers cooling air into the TOBI plenum 292, and the cooling air passes through the plurality of TOBI holes 294 and past a set of metering seals 296, 298. The cooling air then may be directed into a cavity 258 formed between the stator assembly and the rotor assembly. In an embodiment, the stator assembly may include components of the combustion section 206, and rotor assembly may include the components of the turbine wheel assembly 224. In any case, the cavity 258 defines a pathway along which cooling air can travel to purge hot combusted air from the cavity 258, in an embodiment.

In an embodiment, the cavity 258 includes an inner portion and an outer portion. In an embodiment, the inner portion of the cavity 258 may be defined between the TOBI housing 220 and static support structure 218 and the forward cover plate 232.

The TOBI housing 220 and the static support structure 218 are sufficiently spaced from the forward cover plate 232 to allow for the rotor assembly to rotate without contacting the TOBI housing 220 and to allow low velocity cooling air (e.g., cooling air have a velocity in a range of about 0.1 to about 0.3 Mach number) to flow radially outward along the cavity 258 pathway to purge hot combusted air from the cavity 258.

In the outer portion of the cavity 258, which includes an exit opening 280, a flow discouraging device may be included to minimize hot combusted air ingestion. In an embodiment, the flow discouraging device may comprise a single axial overlap between the inner ring 212 of the nozzle 210 and the rotor platform 244 of the blade 228, where a small radial gap is created which causes an area restriction and thus discourages airflow. In this embodiment, a flow discouraging affect may discourage hot combusted air ingestion from the main flowpath 201 into the cavity 258, as well as discourage cooling air from escaping from the cavity 258 and into the main flowpath 201. Though depicted as being included between the inner ring 212 and platform 244 of the blade 228, the flow discouraging device may also or alternatively exist in other locations of a gas turbine engine (e.g., at locations 282, 284).

In other embodiments, the flow discouraging device may have another configuration that may produce the flow discouraging effect, for example, by using chambers and/or multiple axial overlaps. In an example, as shown in FIG. 2, the flow discouraging device may include a double axial overlap configuration, commonly referred to as a "fish-mouth." In an embodiment, the fish-mouth may be formed in the outer portion of the cavity 258 and may be defined between the static support structure 218 and inner ring 212 of the nozzle 210 and the platform 244 of the blade 228.

Figure 3:
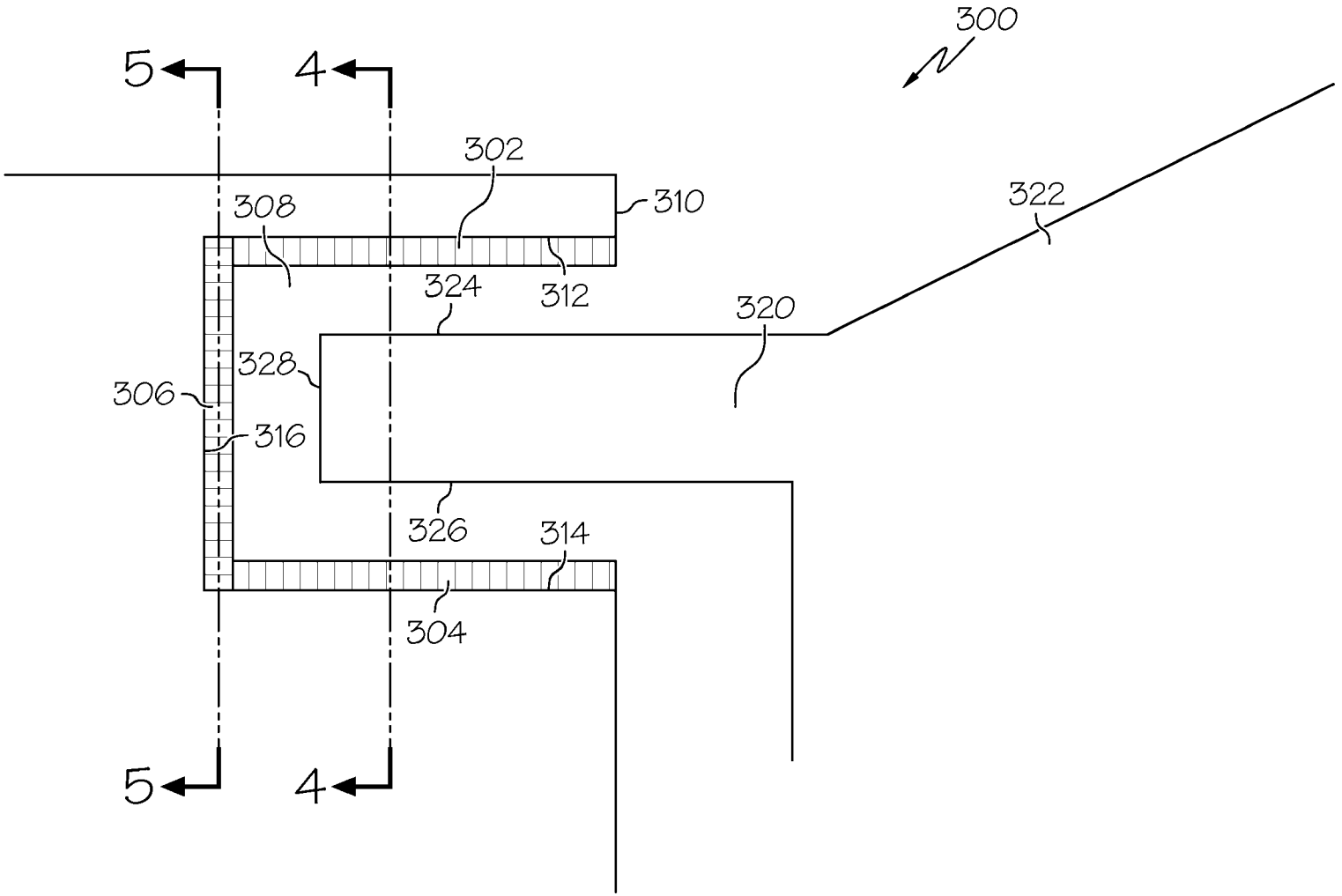
FIG. 3 is a close-up view of an enhanced flow discouraging system, according to an embodiment.

In another embodiment, the fish-mouth flow discouraging system may be enhanced. FIG. 3 is a close-up view of an enhanced flow discouraging system 300, according to an embodiment. In an embodiment, the enhanced flow discouraging system 300 provides a relatively torturous flowpath to the cooling air and the hot combusted air and, in this regard, may include a plurality of fingers 302, 304, 306 may be disposed within an annular groove 308 formed in a side wall 310 of the stator assembly. The side wall 310 may extend radially inwardly from a main flowpath of the engine (e.g., main flowpath 201 of FIG. 2), in an embodiment. In an example, the side wall 310 may comprise more than one component of the stator assembly, such as an inner ring of a nozzle (e.g., inner ring 212 of nozzle 210 in FIG. 2) and a static support structure (e.g., static support structure 218 of FIG. 2). In other embodiments, the side wall 310 may comprise a single component. In an embodiment, although the side wall 310 is depicted as being disposed between a combustion section 206 (FIG. 2) and a turbine section 208 (FIG. 2), the side wall 310 may be alternatively disposed in other locations, positioned radially inwardly or radially outwardly relative to the main flowpath.

As mentioned briefly above, the rotor assembly extends into the annular groove 308 to form a portion of the enhanced flow discouraging system 300, in an embodiment. The rotor assembly may include an annular rim 320, which may extend from a hub 322 configured to rotate during operation. The annular rim 320 extends partially into the annular groove 308 and may comprise a blade platform of a blade, in an embodiment, or a portion of the hub 322, in another embodiment. A clearance may be included between the annular rim 320 and the fingers 302, 304, 306. For example, a clearance from the annular rim 320 to outer axial finger 302 may be in a range of about 0.25 mm to about 0.65 mm, a clearance from the annular rim 320 to inner axial finger 304 may be in a range of about 0.25 mm to about 0.65 mm, and a clearance from the annular rim 320 to radial finger 306 may be in a range of about 0.25 mm to about 0.65 mm. In other embodiments, one or more of the clearances may be greater or less than the aforementioned ranges.

The annular groove 308 is defined by an outer axially-extending surface 312, an inner axially-extending surface 314, and a radial surface 316 extending between the outer and inner axially-extending surfaces 312, 314. According to an embodiment, the annular groove 308 may have a radial height in a range of about 1.9 mm to about 4.7 mm and a depth in a range of about 2.9 mm to about 7.0 mm. In another embodiment, the dimensions of the annular groove 308 may be greater or less than the aforementioned ranges. In still another embodiment, the annular groove walls 312, 314 and the annular rim 320 may be substantially parallel to each other and all disposed at an angle in a range of about 0° to about 45° relative to the centerline. In still other embodiments, the angle may be greater or less than the aforementioned range.

As described above, the plurality of fingers 302, 304, 306 are disposed in the annular groove 308 and extend from one or more stator components. The plurality of fingers 302, 304, 306 extend from one or more of the outer axially-extending surface 312, an inner axially-extending surface 314, and a radial surface 316 toward the annular rim 320. The fingers 302, 304, 306 may be comprised of materials capable of withstanding temperatures in a range of about 0° C. to about 1650° C. According to an embodiment, one or more of the fingers 302, 304, 306 are coupled to the one or more surfaces 312, 314, 316 defining the side wall 310 and may comprise one or more relatively rigid materials, such as titanium, steel alloys, nickel based super alloys or ceramics. In other embodiments, the fingers 302, 304, 306 may comprise one or more materials that are substantially identical to those of the components defining the side wall 310. For example, the fingers 302, 304, 306 may comprise titanium, steel alloys, nickel-based super alloys or ceramics. The fingers 302, 304, 306 can be formed as part of the components defining the side wall 310.

Each of the fingers 302, 304, 306 can be substantially identical in configuration. For example, the fingers 302, 304, 306 can comprise a plurality of cylindrical bristles, each having a cross-sectional shape such as circular, triangular, square, ovular, rectangular or another shape. Each finger may have a cross-sectional area in a range of about 0.1 $mm^2$ to about 1.0 $mm^2$ and a height in a range of about 1.9 mm to about 4.7 mm. In other embodiments, the dimensions of one or more of the fingers may be greater or less than the aforementioned ranges.

The fingers 302, 304, 306 can be relatively closely spaced to form a brush-like texture across the one or more surfaces 312, 314, 316 of the side wall 310. For example, the fingers 302, 304, 306 may be spaced at a density in a range of about 10 fingers per $cm^2$ to 5,000 fingers per $cm^2$. In other embodiments, the fingers 302, 304, 306 are spaced further apart than the aforementioned range. The particular spacing of the fingers 302, 304, 306 may depend on the particular surface from which they extend. Specifically, fingers 302, 304, 306 on one surface 312, 314, 316 may be spaced more closely together than the fingers 302, 304, 306 are spaced on another surface 312, 314, 316. In other embodiments, one section of fingers 302, 304, 306 of one of the surfaces 312, 314, 316 may be more closely spaced together than another section of fingers 302, 304, 306 on the same surface 312, 314, 316. Additionally, in some embodiments, the fingers 302, 304, 306 are uniformly spaced apart. In other embodiments, the fingers 302, 304, 306 are not uniformly spaced.

The fingers 302, 304, 306 are aligned in a plurality of rows. In another embodiment, the fingers 302, 304, 306 in each row are staggered relative to fingers in an adjacent row. In still another embodiment, the fingers 302, 304, 306 are randomly disposed and are not in rows.

In an embodiment in which the fingers extending along the outer axially-extending surface 312 (outer axial fingers 302) are included, the outer axial fingers 302 can extend substantially parallel to each other. The outer axial fingers 302 can be disposed orthogonal relative to a closest surface of the annular rim 320 (e.g., closest surface of outer axial surface 324).

In an embodiment in which the fingers extend along the inner axially-extending surface 314 (inner axial fingers 304), the fingers 304 can extend substantially parallel to each other, in an embodiment. In an embodiment, the fingers 304 are orthogonal to a closest surface of the annular rim 320 (e.g., closest surface of inner axial surface 326

According to an embodiment, one or both of the pluralities of fingers making up the outer and inner axial fingers 302, 304 are dimensioned to provide a radial clearance that is sufficiently sized to allow a portion of a component of the rotor assembly to extend into the gap between the outer axial fingers and the inner axial fingers 302, 304, and to remain spaced apart from the rotor assembly component. In an embodiment, the outer and inner axial fingers 302, 304 may be substantially identically dimensioned. In another embodiment, the plurality of fingers making up the outer axial fingers 302 may be substantially identically dimensioned, and the plurality of fingers making up the inner axial fingers 304 may have dimensions that are different than those of the outer axial fingers 302. In still another embodiment, the plurality of fingers making up the outer axial fingers 302 may not be identically dimensioned, and/or the plurality of fingers making up the inner axial fingers 304 may not be identically dimensioned. In any case, the outer and inner axial fingers 302, 304 may have dimensions that are larger or smaller than the aforementioned ranges, as the particular dimensions may depend on the specific dimensions of the annular groove 308 and the component of the rotor assembly.

In accordance with an embodiment in which fingers extend from the radial surface 316, the fingers (radial fingers 306) extend substantially parallel to each other. Alternatively, some of the radial fingers 306 may be angled relative to other radial fingers 306. The radial fingers 306 can also be substantially orthogonal to a closest surface of the annular rim 320 (e.g., a closest surface of radial surface 328).

Figure 4:
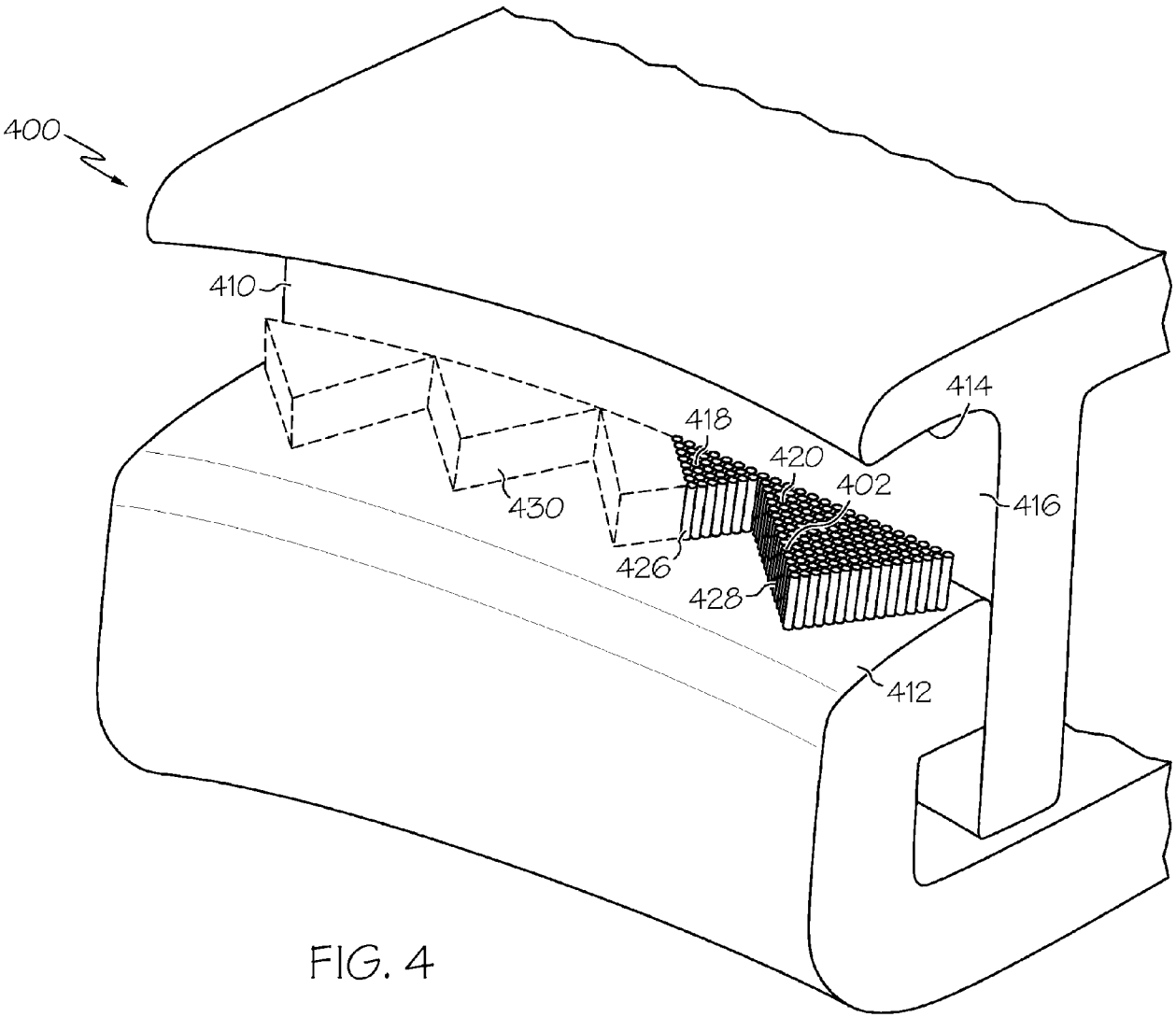
FIG. 4 is a three-dimensional view of a portion of an enhanced flow discouraging system, according to an embodiment.

Each plurality of fingers 302, 304, 306 can be disposed on its respective surface 312, 314, 316 in order to provide a desired texture or pattern. FIG. 4 is a three-dimensional view of a portion of an enhanced flow discouraging system 400 including a plurality of fingers 402, according to an embodiment. Here, the system 400 includes a sidewall 410 defined by an inner axial surface 412, an outer axial surface 414, and a radial surface 416. For the sake of clarity, a plurality of fingers 402 is shown as extending from the inner axial surface 412, however, it will be appreciated that the outer axial surface 414 and/or the radial surface 416 can also or alternatively include fingers in other embodiments. In any case, the plurality of fingers 402 forms a layer across the inner axial surface 412, where the layer is substantially uniform in height and is disposed in multiple sections (e.g., first and second sections 418, 420) that each form a pattern. For example, the sections 418, 420 can be disposed in triangle patterns or another pattern. The fingers of each section 418, 420 can be disposed to thereby form two angled walls 426, 428 forming a zigzag-shaped wall 430 to yield a serrated brush seal-type of configuration, which can define a portion of the tortuous flowpath of the flow discouraging device. In an embodiment, four sections (including 418, 420) are shown; however, in other embodiments, more or fewer sections can be included. Additionally, although the sections 418, 420 are shown as being substantially identical in configuration, one or more of the sections 418, 420 can have different shaped patterns, or the fingers of one or more of the sections 418, 420 can be different in height. Alternatively, one or more of the sections 418, 420 can be larger or smaller than other sections 418, 420.

Figure 5:
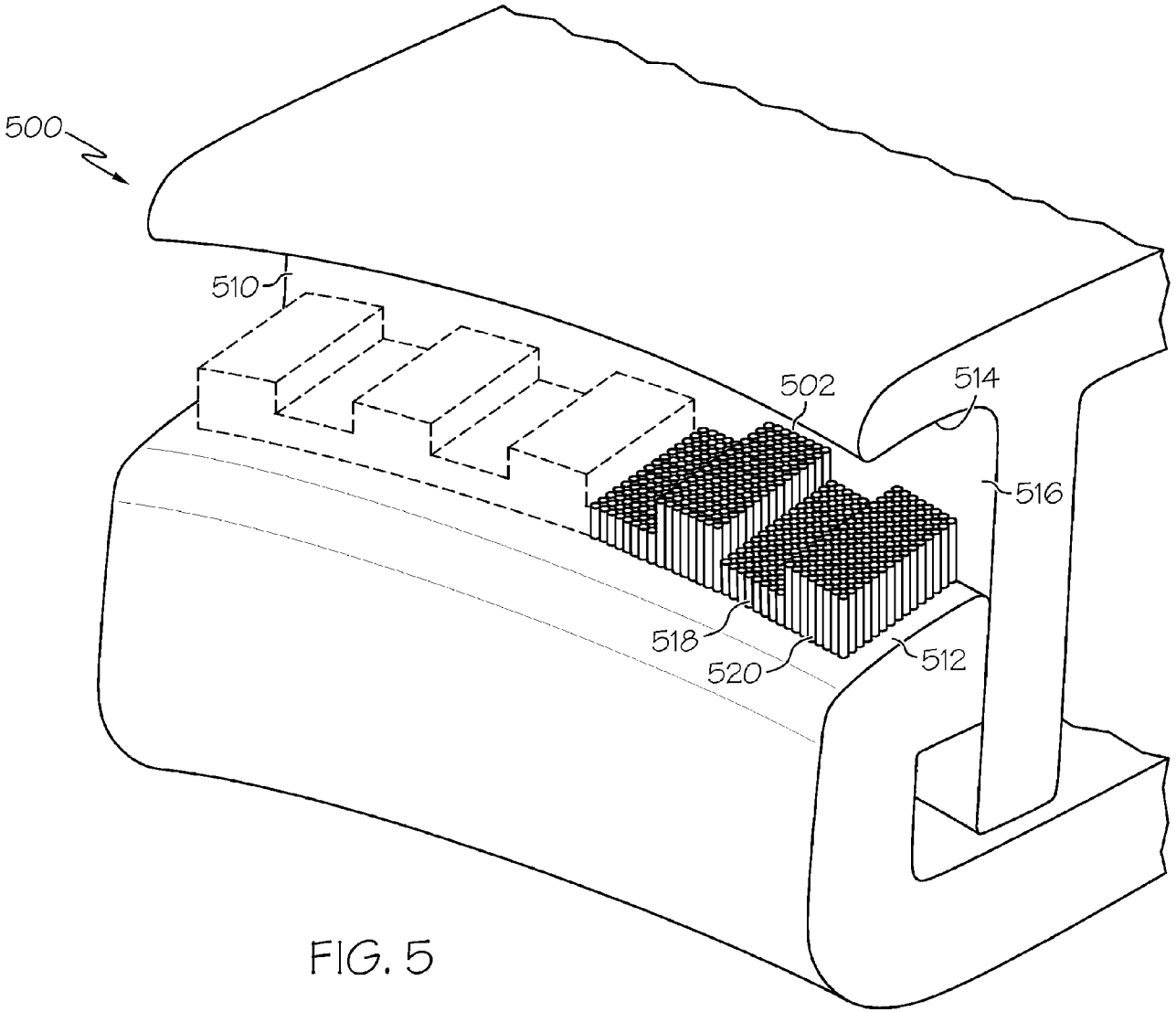
FIG. 5 is a three-dimensional view of a portion of an enhanced flow discouraging system, according to another embodiment.

FIG. 5 is a three-dimensional view of a portion of an enhanced flow discouraging system 500 including a plurality of fingers 502, according to another embodiment. Here, the system 500 includes a sidewall 510 defined by an inner axial surface 512, an outer axial surface 514, and a radial surface 516. For the sake of clarity, a plurality of fingers 502 is shown as extending from the inner axial surface 512. However, the outer axial surface 514 and/or the radial surface 516 can include fingers in other embodiments. The plurality of fingers 502 forms a layer across the inner axial surface 512, where the layer is not substantially uniform in height. In particular, the plurality of fingers 502 includes multiple sections (e.g., first section 518 and second section 520), where each section is different in height. In an embodiment, the first section 518 includes a plurality of fingers that are shorter than the fingers included in the second section 520 to yield a castellated brush seal-type of configuration. Although the fingers of the first section 518 are depicted as being about half the height of the fingers of the second section 520, they may be taller or shorter than depicted. By including fingers of varying heights, a portion of the tortuous flowpath of the flow discouraging device is defined. As will be appreciated, FIGS. 4 and 5 are two examples of sculpturing a shape/surface onto the plurality of fingers. Other types of surface sculpturing could include any arbitrary shape/surface in other embodiments.

Figure 6:
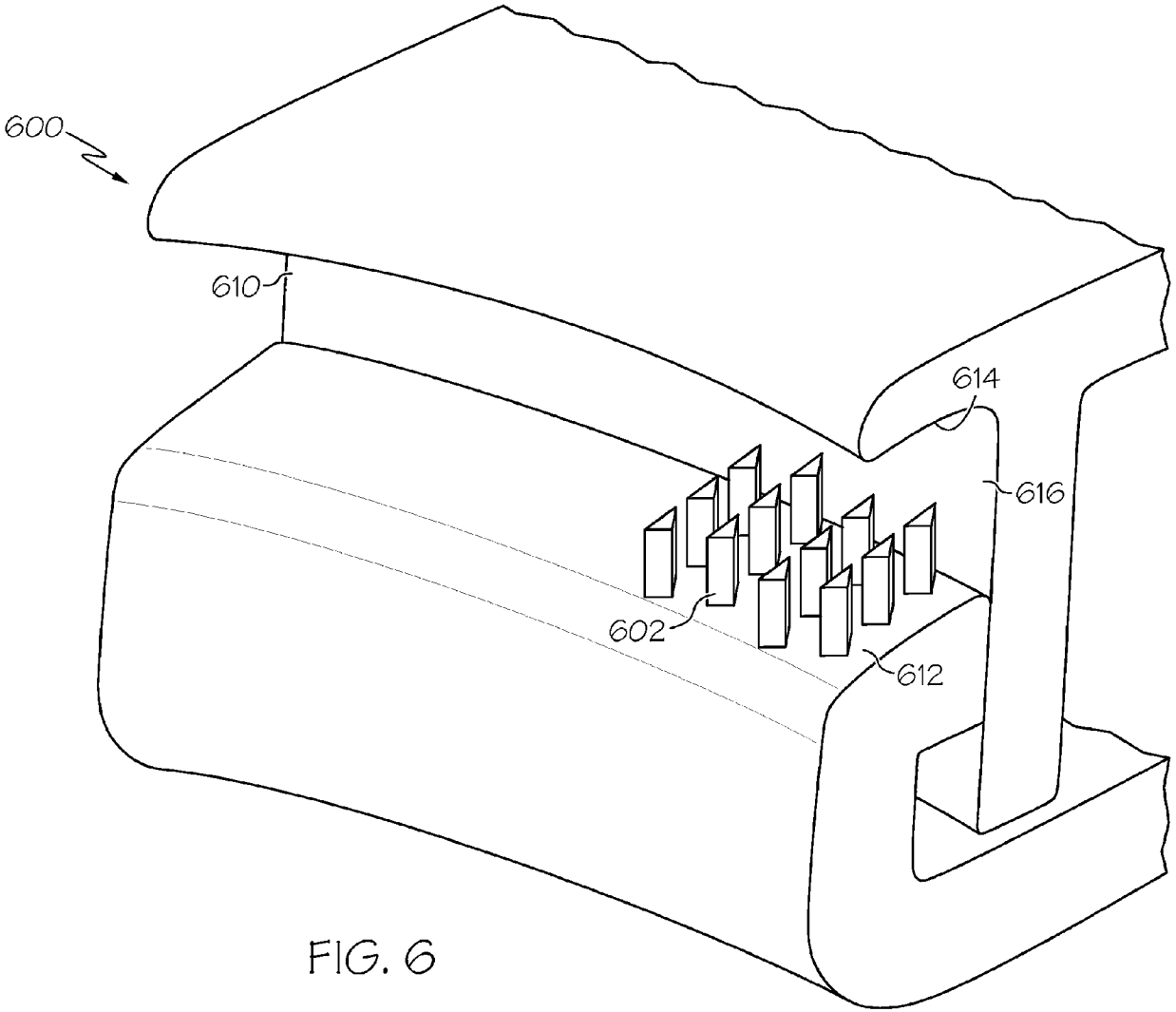
FIG. 6 is a three-dimensional view of a portion of an enhanced flow discouraging system, according to still another embodiment.

FIG. 6 is a three-dimensional view of a portion of an enhanced flow discouraging system 600 including a plurality of fingers 602 according to still another embodiment. Here, the system 600 includes a sidewall 610 defined by an inner axial surface 612, an outer axial surface 614, and a radial surface 616. For the sake of clarity, a plurality of fingers 602 is shown as extending from the inner axial surface 612. However, the outer axial surface 614 and/or the radial surface 616 can include fingers in other embodiments. The fingers 602 are depicted as bristles with a triangular cross section to yield a pin-fin brush seal-type of configuration, while fingers of the previous embodiments included bristles having circular cross sections. Although twelve (12) fingers 602 are shown on a portion of the inner axial surface 612, other embodiments include more or fewer fingers extending over an entirety of the inner axial surface 612 or other surfaces 614, 616.

With reference to FIGS. 2 and 3, during engine operation, hot combusted air flows from the combustion section (e.g., combustion section 106 or 206) to the turbine section (e.g., turbine section 108 or 208). Cooling air is supplied to the cavity 258 between the stator assembly of the combustion section (e.g., nozzle 210) and the rotor assembly of the turbine section (e.g., turbine wheel assembly 224), purging the cavity 258 and then proceeding to the exit opening 280 between the stator assembly and the rotor assembly. As the hot combusted air flows over the enhanced flow discouraging system 300, the cooling air maintains the components at a temperature that is lower than that of the hot combusted air and reduces the likelihood of hot combusted air being ingested into the cavity 258. In particular, when the hot combusted air flows through the nozzle 210, a high velocity flow field is created, which passes over the exit opening 280 of the cavity 258. Because the flow discourager is disposed radially inward relative to the exit opening 280, an actual flow allowed into the cavity 258 may be limited, and the axial/radial velocity components of the ingested hot combusted air may be diminished. By including the enhanced flow discouraging system 300, the tangential velocity component of the ingested hot combusted air may be diminished or minimized. Specifically, the enhanced flow discouraging system 300 may create a back pressure at or near the exit opening 280 to reduce the likelihood of hot combusted air ingestion into the cavity 258. Specifically, the fingers 302, 304, 306 convert the tangential velocity component of the hot combusted air into a local static pressure rise, or backpressure, through an aerodynamic process of stagnation pressure loss and diffusion. Additionally, the back pressure created by the flow discourage system 300 may discourage cooling air from escaping into the main flowpath 201.

Moreover, the enhanced flow discouraging system 300 may also deter the cooling air in the cavity 258 from flowing into the main flowpath 201, which may be particularly important for embodiments that are implemented into small gas turbines where seal (e.g., seals 296, 298) clearances may not be capable of being made small enough to obtain a desired amount of cooling flow. Rather than supplying an overabundance of cooling air to the cavity 258 than desired, which may increase fuel consumption and may have a detrimental effect on the TOBI system, the enhanced flow discouraging system 300 may deter the cooling air from leaving the cavity 258 at the exit opening 280 to provide a more robust cooling system and thereby protect the blade 228 from thermal damage.

The flow discourager enhancement devices that have been described above may enhance any/all types of flow discouraging systems where a cavity is relatively small (e.g., less than 10 mm in width) and where there is high energy tangential flow within the flow discouraging system which can be utilized to create an "aerodynamic seal", when the enhancements are added to the flow discouraging system. Although specific geometric configurations, dimensions and orientations have been discussed with regard to a basic non-enhanced flow discourager system, the enhancement devices discussed may be applied to a variety of basic non-enhanced flow discourager systems, with various geometric configurations, dimensions and orientations, which may not have been discussed. Additionally, although specific geometric configurations, dimensions and orientations have been discussed with regard to the enhancements themselves, enhancements with geometric configurations, dimensions and orientations, which may not have been discussed, would also be applicable. The enhancements may be applied to a non-rotating portion of the non-enhanced flow discourager system and may be generally oriented with the basic non-enhanced flow discourager system to create a relatively uniform clearance between the enhancement and a rotating portion of the non-enhanced flow discourager system. Some modification of a basic non-enhanced flow discourager system may be included to accommodate the enhancements to provide a desired running clearance. In alternative embodiments, the inventive subject matter may be included in a cavity between two static structures 286. In this case, the cavity 286 may comprise a design feature to protect a ceramic shroud 230 from the outer ring 214 of the nozzle 210. Because two static structures form the cavity 286, the inventive subject matter may be applied to both static structures. In still other embodiments, for the inventive subject matter may be implemented in other sections 288 in which a sufficient amount of high energy tangential flow exists.

Although the stator assembly and rotor assembly are described as comprising components from a combustion section and a turbine section of an engine, respectively, adjacent components from other sections of the engine 200 may alternatively be employed. Specifically, the enhanced flow discouraging system 300 may be implemented between various sections in which a non-rotating structure is disposed adjacent to a rotating structure. In any case, inclusion of the enhanced flow discouraging system 300 provides a passive system, not subject to wear with time, for reducing compressor bleed air flow that may be used to cool engine components, which, in turn, may minimally affect engine fuel consumption. Additionally, because the axial fingers 302, 304 and/or the radial fingers 306 may be separate components, the enhanced flow discouraging system 300 may be relatively simple and/or inexpensive to implement into existing engines, as compared to an entire redesign of an engine. Alternatively, because the fingers may be separate components, flow discouraging system enhanced in this way may be relatively simple and/or inexpensive to implement into existing engines, as compared to an entire redesign of an engine.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A flow discouraging system, comprising:

a stator assembly including one or more stationary components forming a side wall, the side wall including an annular groove defined by an outer axially-extending surface, an inner axially-extending surface, and a radial surface extending between the outer and inner axially-extending surfaces;

a rotor assembly disposed adjacent to and spaced apart from the stator assembly to form a portion of a cavity, the rotor assembly including a blade platform at least partially forming a main combustion gas flow path and a blade extending from the blade platform into the main combustion gas flow path, the blade platform further including an annular rim extending at least partially into the annular groove; and a plurality of fingers disposed in the annular groove and extending from the one or more stationary components towards the annular rim, wherein the plurality of fingers extends from the outer axially-extending surface of the side wall, wherein the plurality of fingers extends from the inner axially-extending surface of the side wall, and wherein the plurality of fingers extends from the radial surface of the side wall.

2. The system of claim 1, wherein the plurality of fingers are substantially uniform in height.

3. The system of claim 1, wherein the plurality of fingers includes a first section adjacent to a second section, wherein the plurality of fingers of the first section are shorter in height than the plurality of fingers of the second section.

4. The system of claim 1, wherein the plurality of fingers includes a first section adjacent to a second section, the plurality of fingers of the first section and the plurality of fingers of the second section are each disposed in a triangle pattern.

5. The system of claim 1, wherein the plurality of fingers are aligned to form a zigzag-shaped wall.

6. The system of claim 1, wherein the plurality of fingers are aligned to form a smooth wall.

7. The system of claim 6, wherein the plurality of fingers comprising the wall formed by the first section and the second section are disposed orthogonal to a closest surface of the annular rim.

8. The system of claim 1, wherein each finger of the plurality of fingers comprises a cylindrical bristle having a circular cross section.

9. The system of claim 1, wherein each finger of the plurality of fingers comprises a cylindrical bristle having a non-circular cross section.

10. A gas turbine engine, comprising:

a compressor section;

a combustion section adjacent to the compressor section; and a turbine section adjacent to the combustion section, the turbine section including:

a stator assembly including one or more stationary components forming a side wall, the side wall including an annular groove defined by an outer axially-extending surface, an inner axially-extending surface, and a radial surface extending between the outer and inner axially-extending surfaces;

a rotor assembly disposed adjacent to and spaced apart from the stator assembly to form a portion of a cavity, the rotor assembly including a blade platform at least partially forming a main combustion gas flow path and a blade extending from the blade platform into the main combustion gas flow path, the blade platform further including an annular rim extending at least partially into the annular groove and disposed between the outer axially-extending surface and the inner axially-extending surface, and the cavity in flow communication with the compressor section; and a plurality of fingers disposed in the annular groove and extending from the one or more stationary components towards the annular rim, wherein the plurality of fingers extend from the outer axially-extending surface, the inner axially-extending surface, and the radial surface.

11. The gas turbine engine of claim 10, wherein the plurality of fingers extending from the outer axially-extending surface are substantially uniform in height, the plurality of fingers extending from the inner axially-extending surface are substantially uniform in height, and the plurality of fingers extending from the radial surface are substantially uniform in height.

12. The gas turbine engine of claim 10, wherein the plurality of fingers are aligned to form a zigzag-shaped wall.

13. The gas turbine engine of claim 10, wherein the plurality of fingers are aligned to form a smooth wall.

14. The gas turbine engine of claim 10, wherein each finger of the plurality of fingers has a cross-sectional area in a range of about 0.1 $mm^2$ to about 1.0 $mm^2$.

15. The gas turbine engine of claim 14, wherein a density of the plurality of fingers is in a range of about 10 fingers per $cm^2$ to about 5,000 fingers per $cm^2$.

* * * * *